US005163749A

United States Patent [19]

Wu

[11] Patent Number: 5,163,749

[45] Date of Patent: Nov. 17, 1992

[54] WALL LAMP WITH REFRACTION LENSES

[76] Inventor: Wen-Chon Wu, No. 4-1, Lane 324, An kang Rd., Nei Hu, Taipei, Taiwan

[21] Appl. No.: 856,752

[22] Filed: Mar. 24, 1992

[51] Int. Cl.[5] ..... F21V 3/00

[52] U.S. Cl. ..... 362/290; 362/311; 362/147

[58] Field of Search ..... 362/290, 311, 147

[56] References Cited

U.S. PATENT DOCUMENTS 1,878,632 9/1932 Hacheney ..... 362/290

*Primary Examiner*—Carroll B. Dority

*Attorney, Agent, or Firm*—Varndell Legal Group

[57] ABSTRACT

A wall lamp comprised of a base having a vertical top side wall vertically raising from a peripheral top edge thereof at one side to hold a lamp socket and lamp bulb, a lamp shade made in the shape of a triangular bridge and covered over said lamp socket and lamp bulb, said lamp shade having two opposite rows of parallel slots on two opposite side faces thereof, and refraction lenses secured in two transverse channels on said base at two opposite ends by tightening up screws to refract the light of said lamp bulb passed through said parallel slots.

1 Claim, 2 Drawing Sheets

WALL LAMP WITH REFRACTION LENSES

BACKGROUND AND SUMMARY OF THE INVENTION

The present invention relates to wall lamps, and more particularly, the present invention relates to a wall lamp with refraction lenses which emits radial light rays when electrically connected.

In designing a wall lamp, decorative and lighting effects have become more and more important. Therefore, colored lamp shades may be used for filtrating the light of lamp bulbs. However, using a colored lamp shade in filtrating the light of a lamp bulb can only change the color of the light, but can not produce an attractive lighting effect.

The present invention has been accomplished to provide a wall lamp which can produce an attractive lighting effect by refracting the light of a lamp bulb into radial light rays. This object is achieved by making parallel slots on the two opposite sloping surfaces of a lamp shade which is shaped like a triangular bridge, and attaching two refraction lenses to the base of a wall lamp that is covered by such lamp shade. Therefore, light rays at right angles from the lamp bulb are refracted by the refraction lenses into radial light rays.

DETAILED DESCRIPTION OF THE PREFERRED EMBODIMENT

Figure 1:
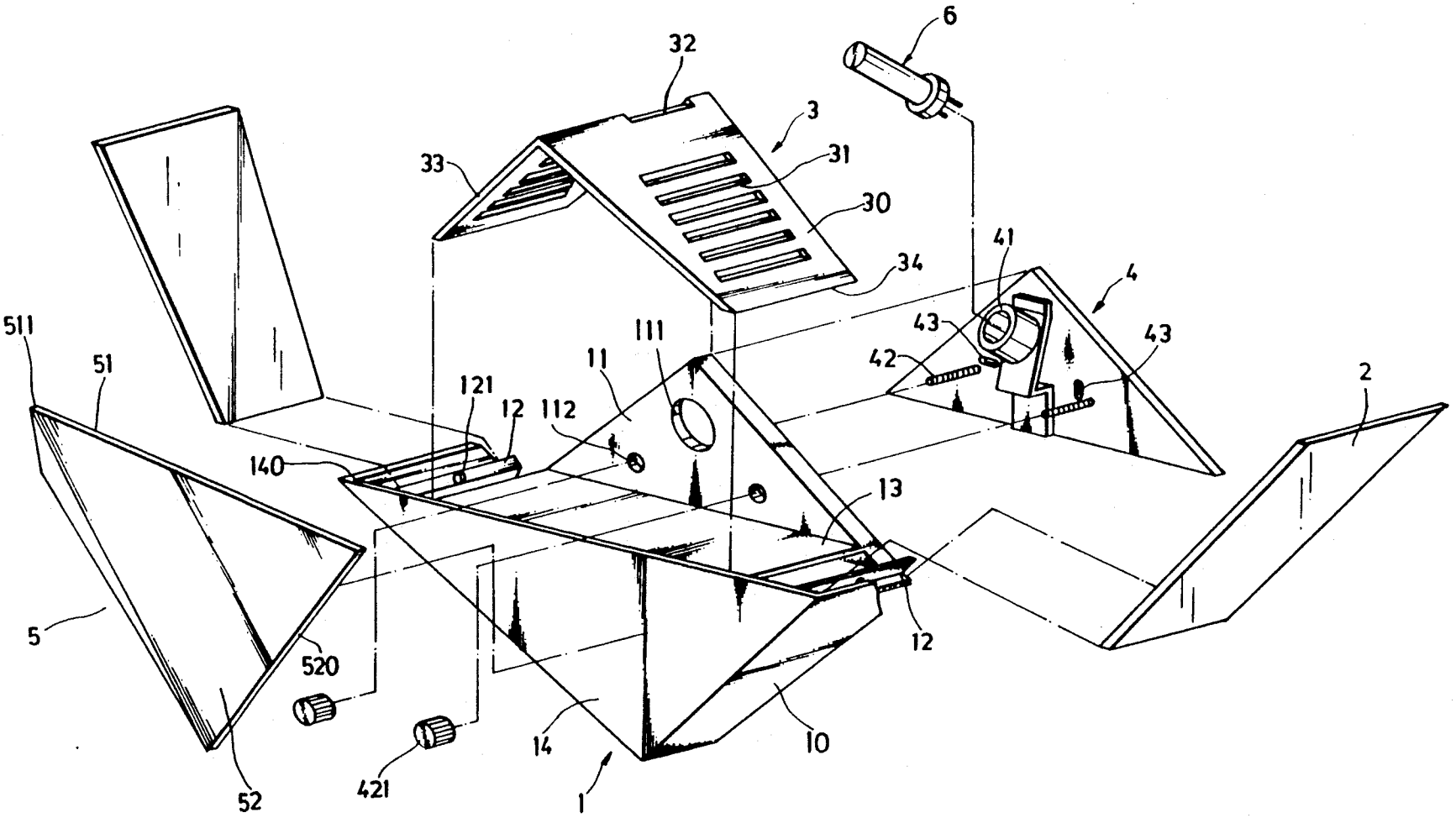
FIG. 1 is an exploded view of a wall lamp embodying the present invention.
Figure 2:
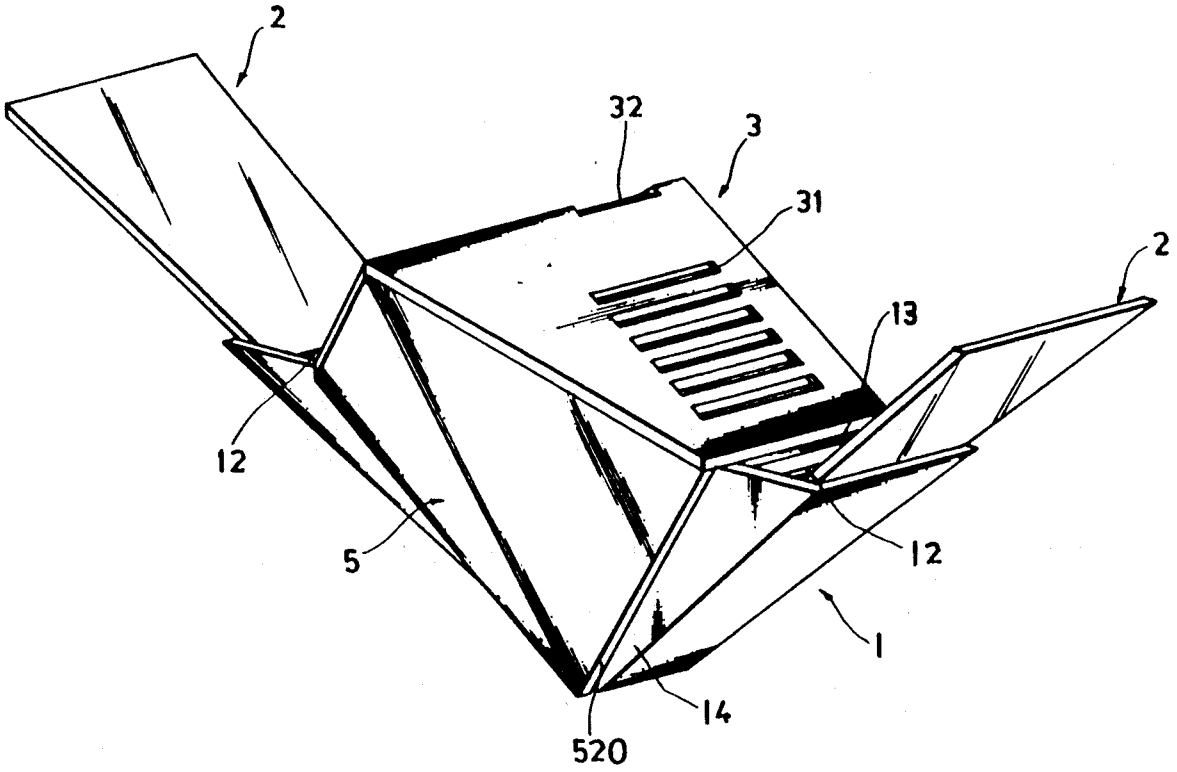
FIG. 2 is an elevational view thereof.

Referring to FIGS. 1 and 2, a wall lamp in accordance with the present invention is generally comprised of a base 1, two refraction lenses 2, a lamp shade 3, a triangular wall plate 4, and a front cover plate 5. The base 1 comprises a rectangular flat top wall 13 transversely disposed at the top, a triangular front bottom side wall 14 and a triangular rear bottom side wall 14' (not shown) vertically downwards extending from the peripheral edge of the rectangular flat top wall 13 at two opposite sides, two rectangular end walls 10 peripherally connected between the triangular front and rear bottom side walls 14 and 14' the peripheral edge of the triangular front side wall 14, a triangular top side wall 11 vertically raising from the peripheral edge of the rectangular flat top wall 13 at the rear side thereof in flush with the triangular rear bottom side wall 14', two L-shaped angle bars 12 transversely respectively formed between the rectangular flat top wall 13 and the two rectangular end walls 10, wherein the triangular top side wall 11 has a lamp socket hole 111 for fastening a lamp socket 41, and through holes 112 for fastening the triangular wall plate 4; the L-shaped angle bars 12 have bolt holes 121 for inserting tightening up screws in securing the refraction lenses 2 thereto. The triangular wall plate 4 is of the same size of the triangular top side wall 11, having through holes 43 for fastening to a flat wall by fastening means (for example, anchors and screws), a screw rods 42 at locations corresponding to the through holes 112 on the triangular top side wall 11, and a lamp socket 41 at one side for mounting a lamp bulb 6. Once the wall plate 4 has been secured to a flat wall, the base 1 is hung on the wall plate 4 permitting the lamp socket 41 and the screw rods 42 to be respectively inserted into the lamp socket hole 111 and the through holes 112 on the triangular top side wall 11, and then, nuts 421 are respectively fastened on the screw rods 42 to firmly secure the base 1 to the triangular wall plate 4. The lamp shade 3 is made in the shape of a triangular bridge comprised of two symmetrical parts 30 obliquely met at one end with parallel slots 31 transversely respectively formed thereon. The lamp shade 3 further comprises a short slot 32 transversely formed on the ridge (the connecting portion between the two symmetrical parts 30) thereof. The length of the short slot 32 is relatively shorter than the parallel slots 31. During the assembly of the wall lamp, the lamp shade 3 is placed on the base 1 at the top with the two opposite bottom edges 34 thereof attached to the rectangular flat top wall 13 between the two L-shaped angle bars 12, and therefore, light rays from the lamp bulb 6 are allowed to pass through the parallel slots 31 for refraction through the refraction lenses 2. The front cover plate 5 is made by bending a rhombic sheet into two triangular walls 52, and attached to the triangular front bottom side wall 14 of the base 1 with a gap (not shown) left between the peripheral back edge 520 thereof and the triangular front bottom side wall 14 for passing the light emitted by the lamp bulb 6, permitting the front end 511 thereof disposed in flush with the front end 140 of the triangular front bottom side wall 14, and permitting the peripheral top edge 51 thereof disposed in flush with the peripheral front side edge 33 of the lamp shade 3.

According to the present invention, a refraction lens 2 may be made from a single layer of glass sheet which filtrates ultraviolet rays. In an alternate form, a refraction lens 2 can be made from a plurality of tinted glasses overlapped one another. When the light emitted by the lamp bulb 6 passes through the refraction lenses 2 which are secured to the L-shaped angle bars 12, it is refracted to produce an attractive lighting effect.

I claim:

1. A wall lamp comprised of a base having a vertical top side wall vertically raising from a peripheral top edge thereof at one side to hold a lamp socket and lamp bulb, a lamp shade covered over said lamp socket and lamp bulb, and refraction lenses attached to said base for refracting the light of said lamp bulb, and characterized in that said base has two transverse channels on a top edge thereof at two opposite ends for inserting said refraction lenses permitting said refraction lenses to be secured to said base by tightening up screws for refracting the light of said lamp bulb passed through parallel slots on said lamp shade.

* * * * *